United States Patent [19]

Watanabe et al.

[11] 4,162,598

[45] Jul. 31, 1979

[54] APPARATUS FOR REMOVING IRREGULAR STACK OF COINS

[75] Inventors: Kenkichi Watanabe; Hideshi Sentoku, both of Tokyo, Japan

[73] Assignee: Laurel Bank Machine Co., Ltd., Japan

[21] Appl. No.: 859,675

[22] Filed: Dec. 12, 1977

[51] Int. Cl.[2] ..... B65B 57/10; B65B 57/12

[52] U.S. Cl. ..... 53/54; 53/73; 53/212

[58] Field of Search ..... 53/54, 73, 212

[56] References Cited

U.S. PATENT DOCUMENTS 4,058,954 11/1977 Asami ..... 53/54

*Primary Examiner*—Travis S. McGehee

[57] ABSTRACT

Herein disclosed is an apparatus for removing an irregular stack of coins for use in a coin packaging machine in which a packaging paper is wrapped around the peripheral face of a columnar stack of a predetermined number of accumulated coins and both the upper and lower ends of the packaging paper are inwardly bent to package the coins. In this irregular stack of coins removing apparatus, an electromagnet for operating a gate disposed on a discharge opening of a guiding spout for guiding coins to a packaged coin store box is actuated synchronously with discharge opening of a shutter device of an accumulating cylinder for accumulating a predetermined number of coins, which shutter device actuated in response to a detection signal emitted from a detector device disposed on the accumulating cylinder or a clear signal indicating the shortage of the number of coins, whereby irregular stacks of coins are not discharged into the coin store box.

3 Claims, 5 Drawing Figures

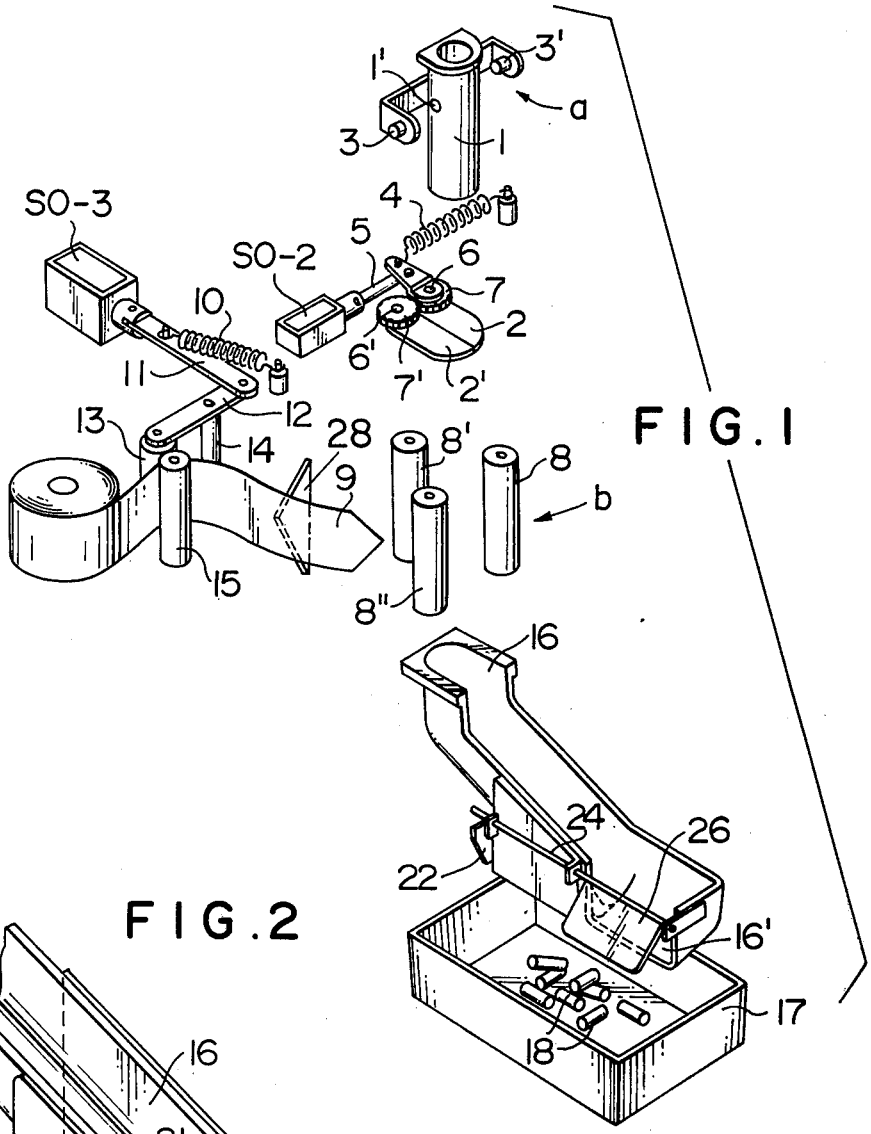
FIG. 1
FIG. 2
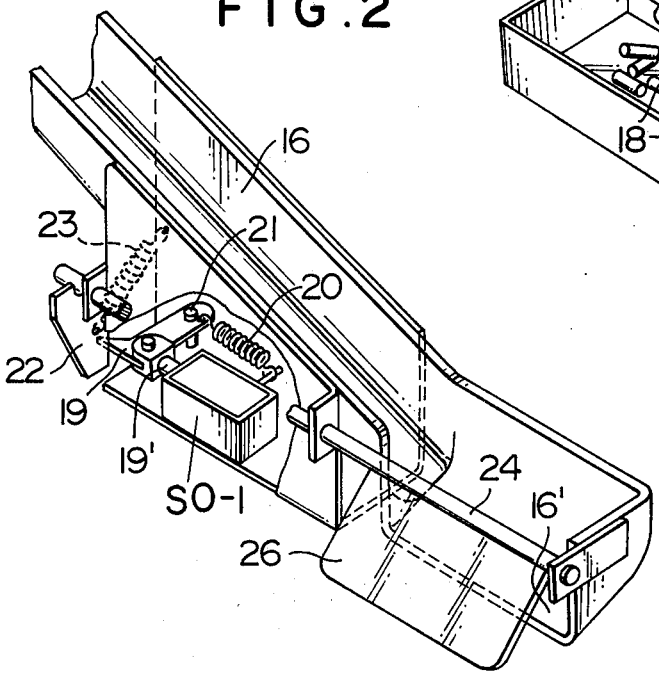

APPARATUS FOR REMOVING IRREGULAR STACK OF COINS

BACKGROUND OF THE INVENTION

The present invention relates to means for disposal of an irregular stack of coins in a coin packaging machine in which a packaging paper is wrapped around the peripheral face of a columnar stack of accumulated coins and both the upper and lower end edges of the paper are inwardly bent by a clamping claw. The present invention is intended to provide means for separating loose coins discharged independently without being packaged from packaged coins and facilitating recovery of these loose coins separately discharged.

In a coin packaging machine, in general, not only packaged coins but also loose coins discharged separately in the non-packaged state by a clear signal or the like are allowed to fall in a store box through a guiding spout disposed below the packaging mechanism and are stored therein.

Accordingly, the loose coins are scattered in the store box and intrude into gaps among the stored packaged coins. These loose coins cannot be recovered before all the packaged coins are taken out and the recovering operation is very troublesome. Further, there is a possibility that some loose coins will be lost when they are scattered.

SUMMARY OF THE INVENTION

The present invention is to eliminate the foregoing disadvantages involved in the conventional coin packaging machine. More specifically, it is a primary object of the present invention to provide an apparatus for removing an irregular stack of coins in which a gate rotatably supported on a discharge opening at the top end of a guiding spout is arranged so that it is always open, an electromagnet is actuated on discharge of an irregular stack of coins to release anchoring of the gate and close the discharge opening of the guiding spout and the irregular coins are thus stored in the guiding spout, whereby irregular coins can be recovered very easily without the possibility of a loss of coins by scattering.

Another object of the present invention is to provide an apparatus for removing irregular coins in which an electromagnet or motor for operating a feed roller for feeding a packaging paper is controlled by a detection signal of a detector device, and even in case of an irregular stack of coins, the forward end of the packaging paper is kept stationary at the initial position for normal operation and, as a result, the position of the forward end of the packaging paper need not be corrected for starting the subsequent operation.

BRIEF DESCRIPTION OF THE DRAWING

The drawing illustrates embodiments of the apparatus of the present invention, in which:

FIG. 1 is a perspective view illustrating the system for accumulating, packaging and discharging coins;

FIG. 2 is a perspective view illustrating the main part of the system shown in FIG. 1;

DETAILED DESCRIPTION OF THE PREFERRED EMBODIMENTS

Figure 3:
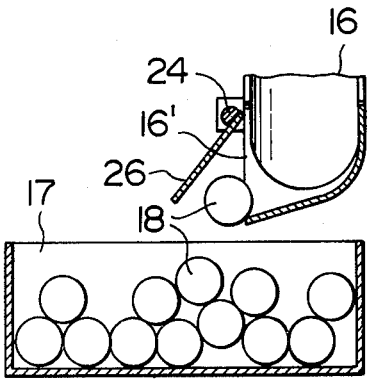
FIG. 3 is a sectional view showing the state of storage during the normal operation.

The present invention will now be described in detail by reference to the accompanying drawings.

When coins are counted one by one by a coin counter (not shown), a counting completion switch SW-5 (see FIG. 5) is closed and a predetermined number of coins are accumulated in a accumulating cylinder 1 on shutters 2 and 2′ constituting the bottom portion of the accumulating cylinder 1. The accumulation state is checked through a through-hole 1′ formed at at predetermined level (depending on the kind of coins to be packaged) by a detecting switch SW-2 including a light projector 3 and a light receiver 3′. When the respective coins are arranged correctly horizontally, the light from the projector 3 is received by a detector a which is part of the light receiver 3′ and closing of the counting completion switch SW-5 results in excitation of a counting completion solenoid RY-3. Accordingly, a contact RY-1-3 is opened, a contact RY-3-2 is closed and self-retained and a contact RY-3-3 is closed to rotate a packaging motor WM, and a delivery arm (not shown) is made to stand by below the shutters 2 and 2′ in proximity thereof while being controlled according to the operation sequence of cams of a cam line (not shown). At this point, a shutter solenoid SO-2 is excited by closing of a cam switch SW-3 and a plunger thereof is attracted against the force of a spring 4. Accordingly, the shutter 2 connected through a link 5 to the solenoid SO-2 is turned around a shaft 6, and simultaneously, also the shutter 2′ is turned in the opposite direction around the shaft 6 by a gear 7′ engaged with a gear 7 fixed to the shutter 2. Since the shutters 2 and 2′ are thus opened, the accumulated coins are transferred to the above-mentioned delivery arm and delivered to a packaging zone b having a plurality of packaging rollers 8, 8′ and 8″.

Substantially simultaneously with the actuation of the shutter solenoid SO-2, a paper feed switch SW-7 is closed by the cams of the above-mentioned cam line to excite a paper solenoid SO-3 for feeding out a packaging paper 9 and therefore, a plunger of the solenoid SO-3 is attracted against the force of a spring 10 and a feed roller 13 mounted on the other end of an arm 12 connected through a link 11 to the solenoid SO-3 is turned around a shaft 14 and brought into pressing contact with a fixed roller 15 which rotates by a predetermined angle at a fixed position. Thus, a predetermined length of the packaging paper 9 is fed out and wrapped around the peripheral side face of the columnar stack of the accumulated coins in the packaging zone b and when the predetermined quantity of the packaging paper 9 is fed out, feed-out of the packaging paper 9 is stopped and the paper 9 is cut by a cutter 28. Then, both the upper and lower end edges of the wrapped paper are inwardly bent by a clamping claw (not shown), and the packaging operation is completed.

When packaging is completed, the delivery arm and clamping claw have already been turned and retreated sideway, and if gripping of the accumulated coins by the packaging rollers 8, 8′ and 8″ is released, the packaged coins 18 are allowed to slide down by gravity on an inclined face of the guiding spout 16 and are turned sideways and stored in a store box 17 below a discharge opening 16′.

Figure 4:
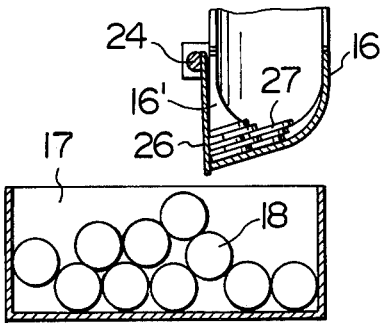
FIG. 4 is a sectional view showing the state of storage in case of an irregular stack of coins.

When accumulated coins in the accumulating cylinder 1 are not arranged correctly in the horizontal state or they are piled vertically or obliquely in such a manner that a regular columnar stack of coins is not formed, the accumulation height exceeds the predetermined level and the light from the projector 3 is intercepted by the accumulated coins. Accordingly, the light receiver 3' cannot receive the light and the detecting switch SW-2 is actuated to close the circuit and energizes a relay RY-2. As a result, a contact RY-2-1 of the relay RY-2 is changed over and a contact RY-2-2 is opened. Accordingly, the circuit of the shutter solenoid SO-2 is opened and the shutters 2 and 2' are not turned for opening. As a result, the accumulated coins are not delivered to the packaging zone b. On closing of a contact RY-2-3, a gate electromagnet SO-1 is excited to attract a plunger 19' and therefore, also a stopper 19 connected to the plunger 19' is turned around a pin 21 against the force of a spring 20, whereby anchoring of an anchoring lever 22 is released and the anchoring lever 22 is turned by the force of a spring 23. Accordingly, the anchoring lever 22 is rotated integrally with a shaft 24 with the anchoring lever 22 being as the fulcrum, and also a gate 26 fixed to the other end of shaft 24 is turned to close the discharge opening 16' of the guiding spout 16 as shown in FIG. 4.

Similarly, since the circuit of the contact RY-2-2 in the paper solenoid SO-3 is opened, the packaging paper 9 is not fed out and is stopped at the predetermined position, namely the initial position for starting the operation. The operation sequence determined by the cams of the cam line advances and at a point close to the point of completion of one cycle, a clear switch SW-4 is actuated by a clear cam (not shown) arranged so that it is actuated at said point close to the point of completion of one cycle and a circuit of the clear switch SW-4 is formed. At this point, the shutter solenoid SO-2 is excited to open the shutters 2 and 2', and the irregular coins held in the accumulating cylinder 1 pass through the packaging zone b in the non-accumulated loose state, are permitted to fall down into the guiding spout 16 and are guided to the discharge opening 16'.

When the normally packaged coins 18 and the above-mentioned unpackaged coins 27 are discharged in the same store box 17, separation is troublesome and in some case, the loose coins are scattered and lost when discharged into the store box 17. This disadvantage is avoided in the present invention in the following manner.

The gate 26 opening or closing the discharge opening 16' is supported by the shaft 24, and the anchoring lever 22 is fixed to the shaft 24. The spring 23 always urges the gate 26 in a direction closing the discharge opening 16' and the stopper 19 abutting against anchoring lever 22 and urging always the gate 26 in an opening direction is interlocked with the plunger 19' of the gate solenoid SO-1. If the stopper 19 is urged in the above-mentioned anchoring direction around the shaft 21 by the spring 20, the contact RY-2-3 closed simultaneously with the actuation of the relay RY-2 by closing the circuit of the detecting switch SW-2 actuates the gate solenoid SO-1 and anchoring of the anchoring lever 22 by the stopper 19 is released. At this point, the gate 26 is closed by the spring 23 and therefore, the loose coins are held in the guiding spout 16 without being scattered in the store box 17. If a receiver such as a receiving saucer is disposed below the discharge opening 16' and the gate 26 is upwardly opened by a hand, the loose coins can be taken out into the receiving saucer. In so doing gate 26 is automatically anchored by the stopper 19, and the normal engagement state between the anchoring lever 22 and the stopper 19 (the open state) can be restored.

Figure 5:
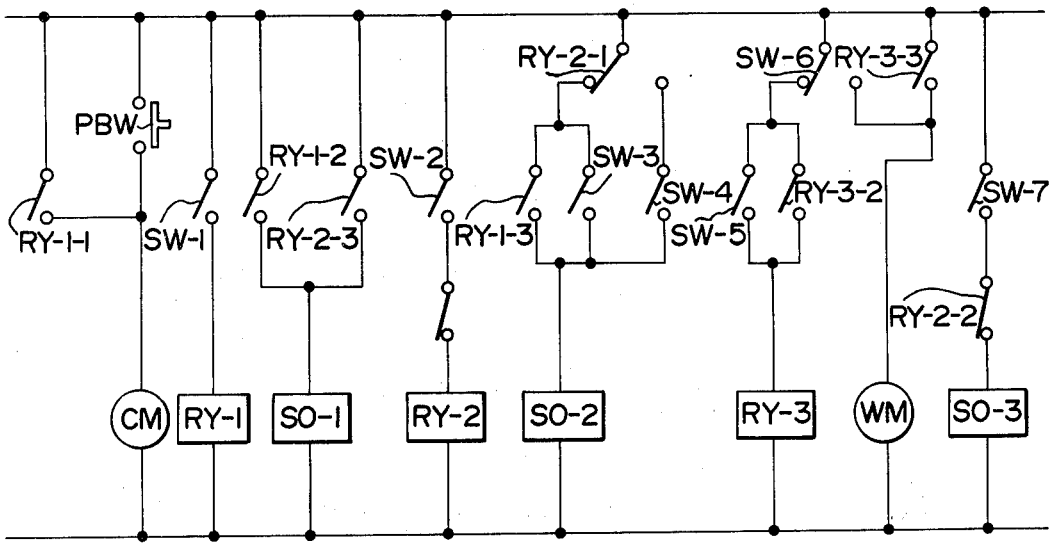
FIG. 5 is a block diagram illustrating an electric circuit.

In the case where the number of accumulated coins is smaller than the predetermined number, as is seen from the electric circuit shown in FIG. 5, the coins are held in the accumulating cylinder 1. Accordingly, in such case, a push button switch PBW is depressed to initiate rotation of a clear motor CM and a switch SW-1 is immediately actuated by a cam (not shown) connected to the clear motor CM to excite a clear relay RY-1 and close a retention contact RY-1-1. Accordingly, even if depression of the push button switch PBW is ceased, rotation of the clear motor CM is continued and predetermined various controls are performed to control the above-mentioned operations.

Further, by changeover of the contact RY-1-2 of the clear relay RY-1, the gate electromagnet SO-1 is excited to cause the above-mentioned gate 26 of the guiding spout 16 to close the discharge opening 16', and simultaneously, by changeover of the contact RY-1-3, the shutter electromagnet SO-2 is excited to open the shutters 2 and 2'. Accordingly, the fraction of the coins held inthe accumulating cylinder 1 are discharged, and fall down into the guiding spout 16, and are blocked and held at the position of the discharge opening 16' by the gate 26.

As will be apparent from the foregoing illustration, according to the apparatus of the present invention having the above-mentioned structure, when coins are not correctly accumulated in the accumulating cylinder or when the number of coins to be finally packaged in smaller than the predetermined number, since falling or loose coins into the store box is manually or automatically prevented by the gate disposed at the top end of the guiding spout, recovery of the loose coins can be performed very easily and loss of the coins by scattering can be prevented.

Still further, if coins are not correctly accumulated in the accumulating cylinder or the number of coins to be finally packaged is smaller than the predetermined number, when the switch is manually or automatically actuated by the detector device for inspecting the accumulation state of the coins, feedout of the packaging paper is simultaneously stopped. Accordingly, when the operation is started again, the initial position of the packaging paper need not be corrected, and the efficiency of the packaging operation can be remarkably enhanced.

What is claimed is:

1. A coin packaging machine comprising:

(a) an accumulating cylinder for accumulating a predetermined number of coins and an electrically operated shutter means to discharge coins from said cylinder;

(b) an electrically operated means adjacent said cylinder to wrap packaging paper around the periphery of a columnar stack of coins coming from said cylinder;

(c) a coin store box adjacent said packaging means and a guiding spout between said packaging means and said coin box for guiding packaged coins to said box;

(d) means for removing irregular coins comprising:

(1) a detector on said cylinder to determine when misstacked coins are accumulated;

(2) an electrically operated gate on said guiding spout positioned to prevent, when closed, coins from entering said box;

(3) electrical means to open said shutter means and close said guiding spout gate when a signal from said detector indicates the presence of misstacked coins.

2. The machine of claim 1 in which said electrical means is connected to prevent operation of said packaging means so that misstacked coins can be removed in a non-packaged loose state.

3. The machine of claim 1 including switch means to actuate said electrical means when an insufficient number of coins is accumulated in the cylinder.

* * * * *